US008975573B2

(12) United States Patent
Rafferty et al.

(10) Patent No.: US 8,975,573 B2
(45) Date of Patent: Mar. 10, 2015

(54) SYSTEMS AND METHODS FOR CALIBRATING MASS SPECTROMETERS

(71) Applicant: 1st Detect Corporation, Austin, TX (US)

(72) Inventors: David Rafferty, Webster, TX (US); James Wylde, Oak Leaf, TX (US); Michael Spencer, Manvel, TX (US); Warren Mino, Friendswood, TX (US)

(73) Assignee: 1st Detect Corporation, Austin, TX (US)

( * ) Notice: Subject to any disclaimer, the term of this patent is extended or adjusted under 35 U.S.C. 154(b) by 13 days.

(21) Appl. No.: 13/794,779

(22) Filed: Mar. 11, 2013

(65) Prior Publication Data

US 2014/0252215 A1 Sep. 11, 2014

(51) Int. Cl.
*H01J 49/00* (2006.01)

(52) U.S. Cl.
CPC ..... *H01J 49/0009* (2013.01)
USPC ..... 250/252.1

(58) Field of Classification Search
CPC ... H01J 49/0009; H01J 49/0436; G01N 1/405
USPC ..... 250/252.1
See application file for complete search history.

(56) References Cited

U.S. PATENT DOCUMENTS

| | | | | | |
|---|---|---|---|---|---|
| 3,948,731 | A * | 4/1976 | Weaver | 435/29 |
| 4,260,886 | A * | 4/1981 | Grilletto et al. | 250/288 |
| 4,847,493 | A * | 7/1989 | Sodal et al. | 250/252.1 |
| 5,498,545 | A | 3/1996 | Vestal | |
| 5,703,360 | A * | 12/1997 | Fischer et al. | 250/288 |
| RE37,485 | E | 12/2001 | Vestal | |
| RE39,353 | E | 10/2006 | Vestal | |
| 7,320,243 | B2 | 1/2008 | Perkins et al. | |
| 7,385,190 | B2 * | 6/2008 | Fischer et al. | 250/288 |
| 7,385,191 | B1 | 6/2008 | McMurtry et al. | |
| 7,427,750 | B2 | 9/2008 | Grossenbacher et al. | |
| 7,576,324 | B2 | 8/2009 | Grossenbacher et al. | |
| 7,618,576 | B2 | 11/2009 | Staats | |
| 7,679,053 | B2 | 3/2010 | Schneider et al. | |
| 7,750,292 | B2 | 7/2010 | Finlay | |
| 7,973,277 | B2 | 7/2011 | Rafferty | |
| 8,207,496 | B2 | 6/2012 | Makarov et al. | |
| 8,299,424 | B2 | 10/2012 | Camilli | |
| 8,304,718 | B2 | 11/2012 | Ouyang et al. | |
| 8,461,517 | B2 * | 6/2013 | Debono et al. | 250/252.1 |
| 2004/0236603 | A1 | 11/2004 | Heller et al. | |
| 2005/0211892 | A1 | 9/2005 | Shimomura | |
| 2007/0009970 | A1 | 1/2007 | Heller et al. | |
| 2007/0295062 | A1 | 12/2007 | Wang | |
| 2008/0067348 | A1 | 3/2008 | Musselman | |
| 2008/0067358 | A1 | 3/2008 | Musselman | |
| 2008/0067359 | A1 | 3/2008 | Musselman | |
| 2009/0057550 | A1 | 3/2009 | Stults et al. | |
| 2011/0315552 | A1 | 12/2011 | Stults et al. | |
| 2013/0043380 | A1 * | 2/2013 | Correale | 250/252.1 |

* cited by examiner

*Primary Examiner* — Marcus Taningco
(74) *Attorney, Agent, or Firm* — Finnegan, Henderson, Farabow, Garrett & Dunner LLP

(57) ABSTRACT

Systems and methods are disclosed for calibrating mass spectrometers. In accordance with one implementation, a system comprises a calibrant chamber within a housing of a mass spectrometer. The system also comprises a permeation tube enclosed within the calibrant chamber, wherein the tube contains a calibrant chemical that continuously outgasses the calibrant chemical. The outgassed calibrant chemical may be introduced to the mass spectrometer for analysis. The system may also comprise a heating block to control the temperature of the calibrant chemical. The system may further comprise a valve that introduces a known amount of the calibrant chemical into the calibrant chamber. In accordance with the present disclosure, systems and methods are provided for calibrating a mass spectrometer abundance scale.

20 Claims, 7 Drawing Sheets

SYSTEMS AND METHODS FOR CALIBRATING MASS SPECTROMETERS

FIELD OF THE DISCLOSURE

The present disclosure relates generally to systems and methods for calibrating mass spectrometers. More particularly, and without limitation, the present disclosure relates to systems and methods for calibrating a mass spectrometer through the use of a calibrant or calibrating chemical.

BACKGROUND OF THE DISCLOSURE

Mass spectrometers are used for determining the chemical composition of a sample, including the masses and chemical structures of sample molecules. Mass spectrometers are precision instruments and measure the constituent chemicals in a sample by measuring the analog signal from, for example, a detector after ions are sorted according to their mass by, for example, an ion trap analyzer. There is a need to produce a spectrum describing the relationship between the mass/charge of ions and their relative abundance, calculated from signals measured from the mass analyzer such as voltage, time, or current. Also, the mass assignment or calibration may change. These changes may be short term and temporary, for example, by changing the ambient temperature; or they may be long term and/or permanent, for example as the instrument ages. One way mass spectrometers may be tuned and calibrated is by using a calibration algorithm, typically performed at the startup of the mass spectrometer or as needed, which may be as often as several times per day to as infrequent as annual.

Previous systems for calibrating a mass spectrometer typically include using either a sample manually applied to the inlet of the instrument or using a vial of liquid sample that is contained within the instrument and has a volatility sufficiently high to generate a concentration in the headspace sufficient to be measured by the mass spectrometer to perform the calibration. A common calibrant is perfluorotributylamine (PFTBA) but many others exist. When the instrument is being calibrated, a valve may open, allowing gas from the vial to flow into the vacuum chamber of the instrument. However, in the case of a portable mass spectrometer, movement may cause the sample to be agitated and potentially contaminate the system. Additionally, the concentration of sample is dependent upon physical parameters, such as volatility, amount of calibrant remaining, temperature, etc.; therefore, it can be difficult to deliver a consistent amount of calibrant to the mass spectrometer, which not only presents difficulty in calibration but can also contaminate the system. Some particularly sticky liquid samples might even last longer, preventing accurate readings from the mass spectrometer for days or even weeks.

Thus, there exists a need to provide a calibrant container for a portable mass spectrometer that eliminates issues associated with movement and can provide a more consistent, regulated sample to the instrument for calibration.

SUMMARY OF THE EMBODIMENTS

The present disclosure provides improved systems and methods for calibrating mass spectrometers.

In accordance with some embodiments, improved systems are provided for calibrating mass spectrometers using a calibrant chamber within a housing of the mass spectrometer and a permeation tube enclosed within the calibrant chamber, wherein the tube contains a calibrant chemical that continuously outgasses the calibrant chemical, and wherein the outgassed calibrant chemical may be introduced to the mass spectrometer for analysis.

In accordance with further embodiments, improved methods are provided for calibrating mass spectrometers comprising coupling a calibrant tube to an inlet of a calibrant chamber within a housing of the mass spectrometer, wherein the calibrant tube is made of permeable material and contains a calibrant chemical that continuously outgasses the calibrant chemical, and introducing the outgassed calibrant chemical to the mass spectrometer for analysis.

BRIEF DESCRIPTION OF THE DRAWINGS

The accompanying drawings, which are incorporated in and constitute a part of this specification, illustrate several embodiments of the present disclosure and together with the description, serve to explain the principles of the disclosed embodiments.

DETAILED DESCRIPTION OF THE EMBODIMENTS

Reference will now be made in detail to the embodiments of the present disclosure described below and illustrated in the accompanying drawings. Wherever possible, the same reference numbers will be used throughout the drawings to refer to same or like parts.

As described below, systems and methods consistent with the disclosed embodiments relate to calibrating a mass spectrometer by using an internal calibrant device. The internal calibrant device may include one or more liquid calibrants used to calibrate the accuracy of the mass spectrometer. The internal calibrant device may also include one or more calibrant tubes made of a permeable material. The permeable tube may be filled with a liquid calibrant, which may evaporate through the micropores in the permeable material to form a gas in an internal calibrant chamber. In the example embodiments, the internal calibrant device is configured to be attached inside the mass spectrometer, and a user may insert permeation tubes inside the internal calibrant device. Given this configuration, the permeation tubes are designed, in certain embodiments, to be portable, such that a calibrant material within the device may be appropriately contained and protected.

Mass spectrometer systems consistent with this disclosure also allow for various calibration techniques. As also described in greater detail below, techniques for calibrating the mass scale or relative abundance of a mass spectrometer are disclosed.

Figure 1:
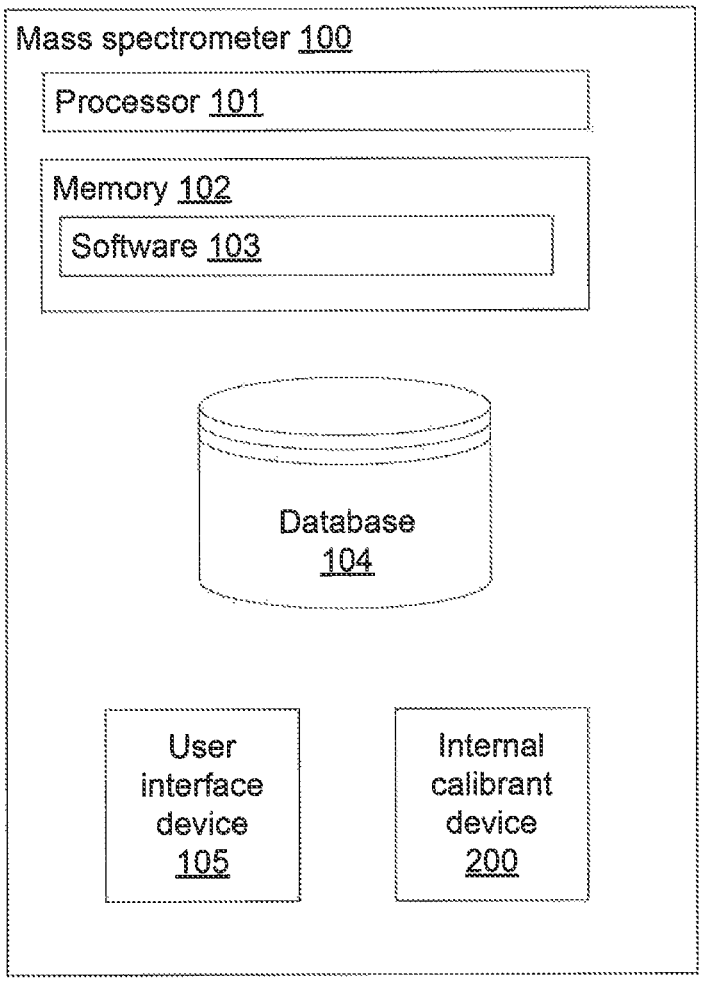
FIG. 1 depicts a block diagram of an exemplary mass spectrometer device in which embodiments consistent with the present disclosure may be practiced and implemented.

FIG. 1 generally depicts an exemplary block diagram of a mass spectrometer 100 having an internal calibrant device 200, consistent with the present disclosure. As disclosed in more detail below, the internal calibrant device 200 may be used to calibrate the spectrometer 100. Towards this end, mass spectrometer 100 of FIG. 1 may include one or more processors 101 and memory devices ("memory") 102 used to implement the calibration functions. Processor 101 and memory 102 may be any type of CPU or memory, and memory 102 may be used to store software 103 for execution by processor 101. For example, software 103 may include a set of instructions used to provide any of the calibration methods or features described herein.

User interface device 105 may be any type of interface, such as a display device, for viewing and interacting with an output spectrum generated by mass spectrometer 100 and internal calibrant device 200. User interface device 105 may include any type or combination of input/output devices, such as a display monitor, keyboard, touch screen, and/or mouse. Mass spectrometer 100 may also include a database 104 for storing calibration information used in the disclosed embodiments. In one implementation, database 104 may store a library of spectrum data, such as the National Institute of Standards and Technology's (NIST) library spectra for a variety of known calibrant chemicals. As known in the art, NIST provides a mass spectral reference library for many chemicals, which may include calibrants chosen for use in a mass spectrometer. Other reference spectra may also be contemplated.

Figure 2:
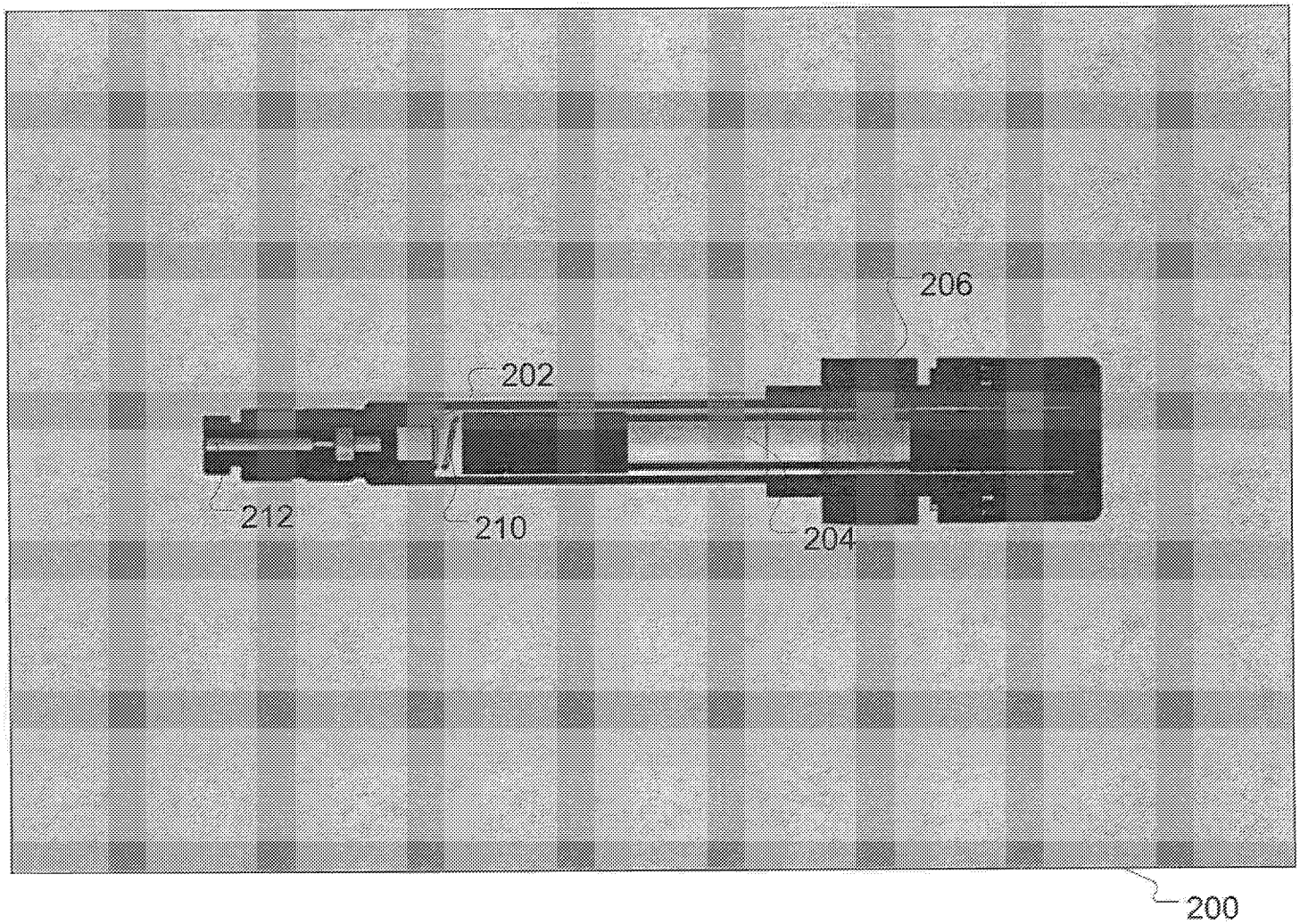
FIG. 2 depicts a diagram of an exemplary calibrant device for use with a mass spectrometer in which embodiments consistent with the present disclosure may be practiced and implemented.

FIG. 2 depicts an exemplary embodiment of internal calibrant device 200 for use with a mass spectrometer 100, consistent with the present disclosure. In certain embodiments, calibrant device 200 may be used to provide the known masses for "mass scale" calibration of mass spectrometer 100. As shown in FIG. 2, device 200 may include a calibrant chamber 202, a calibrant permeation tube 204, a cover 206, a spring 210, and an outlet 212, which may include a valve. The valve may be configured such that it allows a sufficient amount of calibrant into mass spectrometer 100 to allow the calibration function to be performed without compromising the integrity of the vacuum required for operating the mass analyzer.

In reference to FIG. 2, calibrant chamber 202 may be defined by the housing of device 200 and form a chamber in which calibrant permeation tube 204 may be received or inserted. In one implementation, chamber 202 has a cylindrical construction that is appropriately sized to accommodate tube 204. Because mass spectrometer 100 may be portable, chamber 202 may be dimensioned to hold tube 204 within it in a secure manner. To receive the calibrant permeation tube 204, chamber 202 (or the housing defining chamber 202) may be formed to have an inlet or open end through which tube 204 may be inserted into calibrant chamber 202. After calibrant tube 204 is inserted into chamber 202, cover 206 may then be used to close or cover the open end of chamber 202. In this fashion, internal calibrant device 200 may allow for easy replacement of calibrant permeation tube 204—e.g., for when the calibrant inside the tube has been exhausted or for when a different calibrant is desired to be used for calibration of mass spectrometer 100. In one embodiment, chamber 202 may be threaded such that cover 206 may screw onto chamber 202. Accordingly, chamber 202 may thus be opened to allow for insertion of calibrant tube 204 by operation of screw-on cover 206.

In one embodiment, internal calibrant device 200 may be configured with a filter near outlet 212. For example, calibrant device may include a filter (such as a glass frit or a membrane (e.g., PDMS)) for preventing contaminants, which may have been introduced into calibrant chamber 202 during the replacement of the calibrant tube 204, from being introduced into the analysis chamber.

Calibrant tube 204 may be formed of a permeable material. For example, tube 204 may be formed of Teflon. Other permeable materials may also be contemplated. In this way, a calibrant sample contained within tube 204 may permeate out of tube 204 and into calibrant chamber 202 during a calibration function. In other words, the calibrant sample may allow vapor to permeate through the micropores of tube 204 regardless of the phase of the material in the tube. As described below, when calibrant device 200 is coupled to mass spectrometer 100, device 200 may then be configured to allow the permeated gas to then flow through outlet 212 of calibrant device 200. As also described below, outlet 212 of device 200 may be coupled to an inlet (not shown) of mass spectrometer 100 to allow the permeated calibrant gas to flow towards an analysis chamber of spectrometer 100 as part of a calibration function.

Permeation tube 204 may contain a calibrant chemical for calibrating mass spectrometer 100 of internal calibrant device 200. Permeation tube 204 may be configured to continuously outgas the calibrant chemical at ambient temperature. Therefore, permeation tube 204 does not need to be heated in order to calibrate the mass spectrometer. In other embodiments, as further disclosed herein, permeation tube 204 may be heated to perform further calibration functions, such as calibrating the abundance scale. In one embodiment, permeation tube 204 may be comprised of Teflon, including Teflon rods crimped onto the ends of permeation tube 204. Other materials that allow outgassing at ambient temperatures are contemplated by this disclosure.

In one embodiment, permeation tube 204 may be secured in chamber 202 through the use of spring 210, or similar resilient member. In this way, tube 204 may be easily expelled from chamber 202 when cover 206 is removed. Spring 210 may also function to press tube 204 against cover 206 to help ensure tube 204 is stable or fixedly located in chamber 202.

While permeation tube 204 may provide a known chemical for calibration of mass spectrometer 100 by using a known calibrant chemical stored in tube 204, the concentration of the gas emitting from tube 204 may be unknown and, thus, only allow calibration of the mass scale but not the abundance scale. To address this possibility, other embodiments are disclosed that provide a known gas concentration from tube 204 in order to calibrate the relative abundance scale of mass spectrometer 100.

Figure 3:
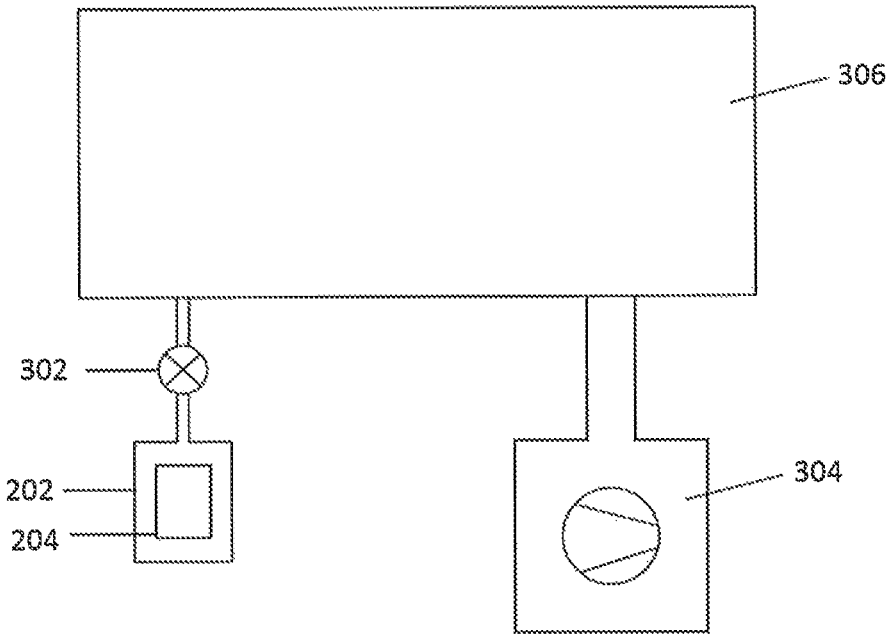
FIG. 3 depicts a block diagram of an exemplary mass spectrometer having a calibration system in which embodiments consistent with the present disclosure may be practiced and implemented.

FIG. 3 illustrates an exemplary diagram of a mass spectrometer system for carrying out a calibration function. FIG. 3 generally illustrates calibrant chamber 202 as being configured to enclose calibrant tube 204 and as being connected to mass analyzer 306 through a valve 302. In operation, a sample containing a chemical for calibrating mass spectrometer 100 may be introduced to mass analyzer 306 through an inlet port containing valve 302. Valve 302 may open (e.g., at the direction of a user seeking to calibrate mass spectrometer 100 or under the control of automated software of mass spectrometer 100), allowing the sample (e.g., the gas emitted by the calibrant chemical) to flow into mass analyzer 306. Valve 302 may be configured with, for example, an orifice to prevent the vacuum of the mass spectrometer from being compromised. In another embodiment, valve 302 may be operated, for example, in a pulsed manner to allow the vacuum of mass spectrometer 100 to be compromised. Further, valve 302 may be specified as a low flow rate valve, such as a leak valve. Mass analyzer 306 may then ionize the calibrant sample and analyze it for calibrating mass spectrometer 100.

Figure 4:
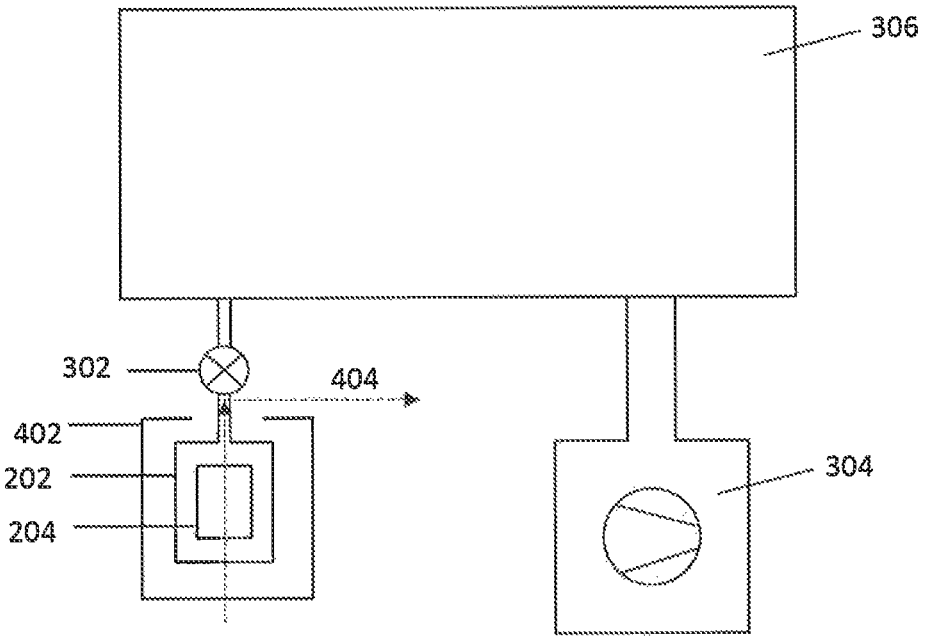
FIG. 4 depicts a block diagram of an exemplary mass spectrometer having a heating block in which embodiments consistent with the present disclosure may be practiced and implemented.

FIG. 4 illustrates an example embodiment of a mass spectrometer system when using a calibrant that may require heating during a calibration function. As shown in FIG. 4, the system may include a heating block 402 for enclosing calibrant chamber 202. In this implementation, heating block 402 may be used to heat the calibrant chemical in permeation tube 204. The permeation rate of a chemical through a porous membrane (e.g., tube 204) may be a function of temperature, as described by Fick's Law. This may be desirable when, for example, calibrating not only the mass scale of the spectrometer, but also calibrating the abundance scale of the mass spectrometer. For instance, to calibrate the abundance scale may require knowing the precise amount of the chemical sample being used as the calibrant. If the temperature of the chemical sample is known or controlled at the time of calibration, then the permeation rate of tube 204 may be known. If the permeation rate of tube 204 into chamber 202 is known, and the flow rate 404 of a matrix gas passing through chamber 202 is known, then a known concentration is delivered to mass spectrometer 100 via valve 302 (if the flow rate through valve 302 is controlled via an aforementioned means). Matrix gas flow 404 may be configured to reduce the dead volume upstream of valve 302. The flow of the matrix gas 404 through chamber 202 may be supplied by a pump (not shown) external to mass spectrometer 100 or by mass spectrometer 100's pumping system 304. Valve 302 may also be an orthonormal valve. Therefore, by controlling the temperature of the tube 204 and the flow 404 of the gas over tube 204, mass spectrometer 100 may calibrate the abundance scale.

Figure 5:
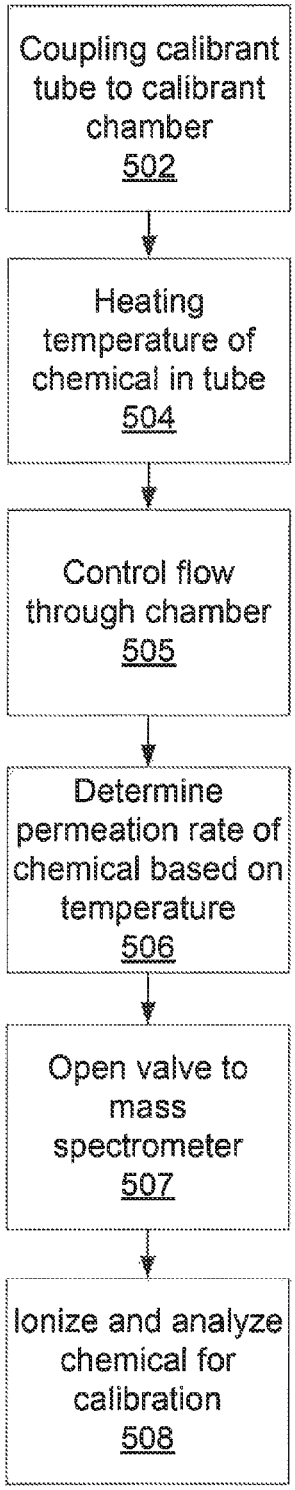
FIG. 5 depicts a flowchart of an exemplary method for calibrating a mass spectrometer's mass and/or relative abundance, consistent with the present disclosure.

FIG. 5 illustrates a flowchart of an exemplary method 500 or carrying out a calibration function, consistent with the disclosed embodiments. In step 502, the method may include coupling tube 204 to calibrant chamber 202 via an inlet. Calibrant tube 204 may contain a calibrant chemical that continuously outgasses through a porous membrane of tube 204. The method may also include heating the chemical in tube 204 in step 504. The permeation rate of a chemical through a porous membrane (e.g., tube 204) may be a function of temperature, as described by Fick's Law. Thus, the concentration in the calibration system may be controlled by controlling the temperature of the chemical and the flow ate 404 of the gas. In step 505, the flow rate 404 of the matrix gas over tube 204 is controlled. In step 506, the concentration of the chemical in chamber 202 may be determined based on the temperature of the tube 204 and the flow 404 of the gas. In step 507, valve 302 may be opened to allow a known concentration of chemical to enter mass spectrometer 100. In step 508, the chemical may be ionized and analyzed for calibrating mass spectrometer 100. Mass spectrometer 100 may be calibrated on one or more of the mass scale or the abundance scale.

Figure 6:
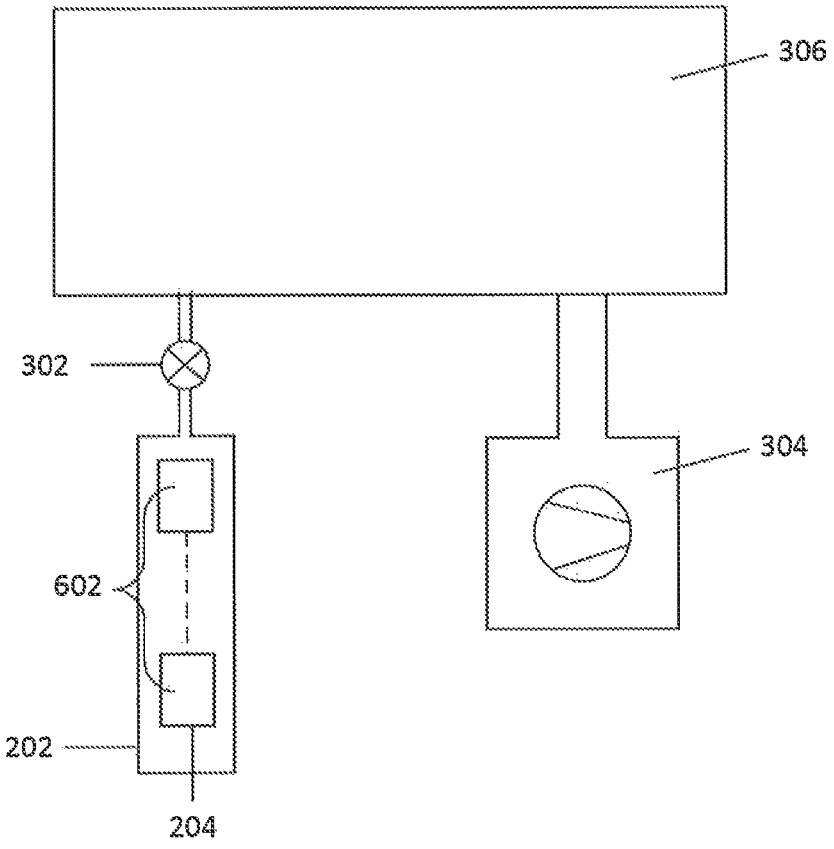
FIG. 6 depicts a block diagram of an exemplary mass spectrometer having multiple calibrant devices in which embodiments consistent with the present disclosure may be practiced and implemented.
Figure 7:
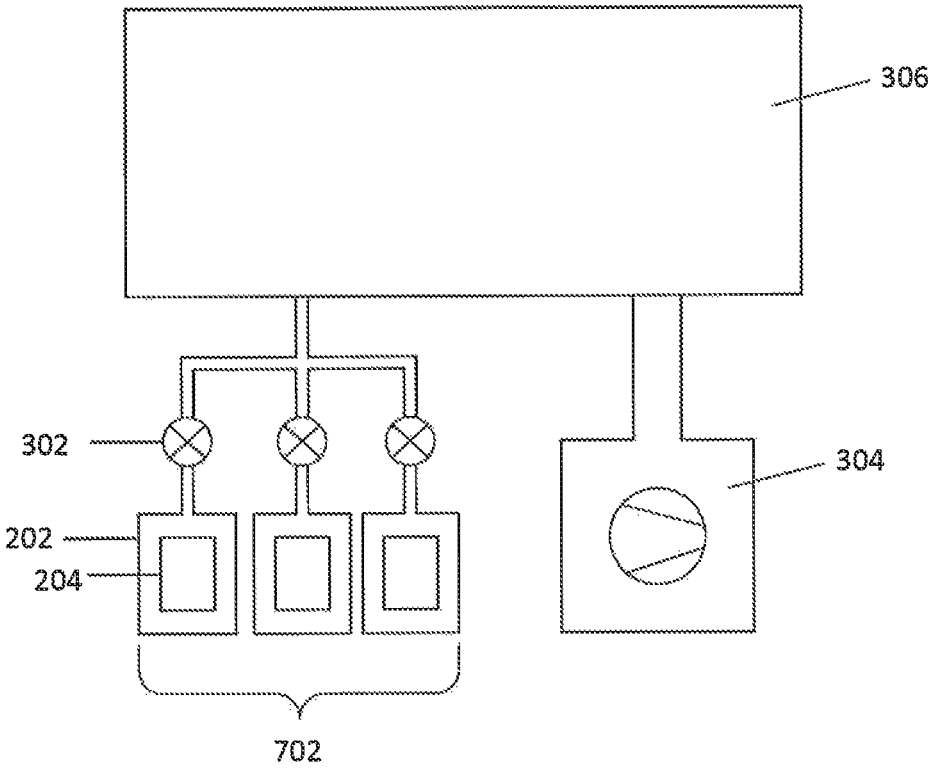
FIG. 7 depicts a block diagram of an exemplary mass spectrometer having multiple calibrant chambers in which embodiments consistent with the present disclosure may be practiced and implemented.

FIG. 6 discloses a further exemplary embodiment of a mass spectrometer system when using multiple calibrant tubes during a calibration function. As shown in FIG. 6, the system may include an internal array 602 of calibrant tubes 204. Each tube may be placed in parallel or in series in a calibrant chamber 202. Each tube may contain a different calibrant chemical. This may be desirable when, for example, calibrating mass spectrometer 100 based on multiple calibrant chemicals with different permeation rates to calibrate on the abundance scale. In another exemplary embodiment, disclosed in FIG. 7, the system may include a flat or round array 702 of calibrant chambers 202 coupled in parallel or series, also for calibrating mass spectrometer 100 using multiple calibrant chemicals. Chamber 202 also contains a flow of matrix gas (not shown) that operates similar to that of FIG. 4, as described herein.

Moreover, while illustrative embodiments have been described herein, the scope thereof includes any and all embodiments having equivalent elements, modifications, omissions, combinations (e.g., of aspects across various embodiments), adaptations and/or alterations as would be appreciated by those in the art based on the present disclosure. For example, the number and orientation of components shown in the exemplary systems may be modified. Further, with respect to the exemplary methods illustrated in the attached drawings, the order and sequence of steps may be modified, and steps may be added or deleted.

Embodiments of the present disclosure address one or more of the above-identified drawbacks and needs in the art.

The foregoing description has been presented for purposes of illustration. It is not exhaustive and is not limiting to the precise forms or embodiments disclosed. Modifications and adaptations will be apparent to those skilled in the art from consideration of the specification and practice of the disclosed embodiments. For example, the various components of the system of FIG. 1 may include an assembly of hardware, software, and/or firmware, including memory, a central processing unit ("CPU"), and/or a user interface. Memory may include any type of RAM or ROM embodied in a physical storage medium, such as magnetic storage including floppy disk, hard disk, or magnetic tape; semiconductor storage such as solid state disk ("SSD") or flash memory; optical disc storage; or magneto-optical disc storage. A CPU may include one or more processors for processing data according to a set of programmable instructions or software stored in memory. The functions of each processor may be provided by a single dedicated processor or by a plurality of processors.

Programmable instructions, including computer programs, based on the written description and disclosed embodiments are within the skill of an experienced developer. The various programs or program modules described in this disclosure may be created using any of the techniques known to one skilled in the art or may be designed in connection with existing software. For example, program sections or program modules may be designed in or by means of C#, Java, C++, HTML, XML, CSS, JavaScript, or HTML with included Java applets.

The claims are to be interpreted broadly based on the language employed in the claims and not limited to examples described in the present specification, which examples are to be construed as non-exclusive. Further, the steps of the disclosed methods may be modified in any manner, including by reordering steps and/or inserting or deleting steps.

It is intended, therefore, that the specification and examples be considered as exemplary only. Additional embodiments are within the purview of the present disclosure and claims.

What is claimed is:

1. A system for calibrating a mass spectrometer, the system comprising:

a calibrant chamber within a housing of the mass spectrometer; and a permeation tube enclosed within the calibrant chamber, wherein the permeation tube contains a calibrant chemical and is configured to continuously outgas the calibrant chemical, wherein the calibrant chamber is configured to introduce the outgassed calibrant chemical to the mass spectrometer for analysis.

2. The system in claim 1, further comprising:

a heating block to control the temperature of the permeation tube.

3. The system in claim 1, wherein the permeation tube is made of Polytetrafluoroethylene (PTFE).

4. The system in claim 1, further comprising a valve, wherein the valve is configured to introduce a known amount of the calibrant chemical into the calibrant chamber.

5. The system in claim 4, wherein the valve is configured to allow an amount of known chemical to enter into the mass spectrometer.

6. The system in claim 5, wherein the valve includes an orifice.

7. The system in claim 4, wherein the valve operates in a pulsed manner.

8. The system in claim 4, wherein the valve is a low flow rate valve.

9. The system in claim 4, wherein the valve is an orthonormal valve.

10. The system in claim 1, further comprising at least two calibrant chambers within the housing of the mass spectrometer.

11. The system in claim 10, wherein the calibrant chambers are arranged in parallel within the housing.

12. The system in claim 10, wherein the calibrant chambers are arranged in series within the housing.

13. The system in claim 1, further comprising at least two calibrant tubes within the calibrant chamber.

14. The system in claim 13, wherein the calibrant tubes are arranged in parallel within the calibrant chamber.

15. The system in claim 13, wherein the calibrant tubes are arranged in series within the calibrant chamber.

16. The system of claim 1, wherein the calibrant chamber is configured to allow a matrix gas to flow over the permeation tube at a controlled flow rate.

17. A method for calibrating a mass spectrometer, the method comprising:

coupling a calibrant tube within a calibrant chamber to an inlet of the mass spectrometer, wherein the calibrant tube is made of permeable material;

allowing the calibrant tube to continuously outgas a calibrant chemical into the calibrant chamber; and introducing the outgassed calibrant chemical to the mass spectrometer for analysis.

18. The method of claim 17, further comprising:

controlling the temperature of the calibrant tube.

19. The method of claim 17, further comprising:

controlling the flow of a matrix gas over the calibrant tube.

20. The method of claim 17, further comprising:

introducing a known amount of the calibrant chemical into the calibrant chamber using an orthonormal valve.

* * * * *